US006282918B1

(12) United States Patent
Levin et al.

(10) Patent No.: US 6,282,918 B1
(45) Date of Patent: Sep. 4, 2001

(54) ABSORPTION REFRIGERATING APPARATUS CONSTITUTED TO PREVENT CORROSION INSIDE IT

(75) Inventors: Per Levin, Budapest (HU); Staffan Eriksson, Stockholm; Carl Lindhagen, Motala, both of (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/488,876

(22) Filed: Jan. 21, 2000

(30) Foreign Application Priority Data

Jan. 29, 1999 (SE) ..... 9900301

(51) Int. Cl.[7] ..... F25B 15/00
(52) U.S. Cl. ..... 62/476; 62/494
(58) Field of Search ..... 62/494, 476, 490, 62/493

(56) References Cited

U.S. PATENT DOCUMENTS 4,185,470 * 1/1980 Eber ..... 62/496
4,362,029 * 12/1982 Blomberg et al. ..... 62/497
4,914,919 * 4/1990 Walfridson et al. ..... 62/236
5,001,904 * 3/1991 Blomberg ..... 62/238.3

* cited by examiner

*Primary Examiner*—William Doerrler
*Assistant Examiner*—Melvin Jones
(74) *Attorney, Agent, or Firm*—Pearne & Gordon LLP

(57) ABSTRACT

In an absorption refrigerating apparatus (18) the pump pipe (42) is made of a material, which is more corrosion resistant to the working medium than the material of the rest of the apparatus. In order to prevent galvanic corrosion in the boiler the pump pipe (42) can be electrically insulated (72, 74) from the rest of the boiler.

6 Claims, 1 Drawing Sheet

ABSORPTION REFRIGERATING APPARATUS CONSTITUTED TO PREVENT CORROSION INSIDE IT

The invention refers to an absorption refrigerating apparatus of steel, where a refrigerant by means of an absorption liquid, in which the refrigerant is dissolvable, circulates through in turn a boiler where refrigerant is liberated from the absorption liquid, a condenser where the refrigerant condenses, an evaporator where the refrigerant evaporates, an absorber where the refrigerant is absorbed by the absorption liquid, and an absorber vessel for collecting the absorption liquid, from which absorber vessel the absorption liquid circulates back to the boiler, where the absorption liquid is heated in a so-called pump pipe so that the refrigerant is again liberated from the absorption liquid.

Such a refrigerating apparatus is known through e.g. EP patent No. 366 633.

Absorption refrigerating apparatuses are usually made of soft carbon steel. The reason for this is that the cold working qualities and weldability are very good at the soft carbon steel. In order to avoid corrosion in the apparatus, where the absorption liquid is water and the refrigerant ammonia, a small amount of sodium chromate ($Na_2CrO_4$) is added to the water-ammonia solution. A thin film consisting of chrome and iron oxides ($Cr_2O_3$ and $Fe_2O_4$)is built up on the surface of the steel tubes and protects the apparatus from corrosion. If a crack would appear in the protecting film, more chromate is immediately taken from the solution to repair the crack.

Such hexavalent chrome combinations are, however, poisonous for human beings and possibly cancerogenic, and it is therefore desirable to exclude these substances from the apparatus.

If on the other hand a corrosion inhibitor is missing in the apparatus magnetite is formed under development of hydrogen gas according to the following sum reaction:

$$3Fe+4H_2O \rightarrow Fe_3O_4+4H_{2(g)}$$

The reaction velocity at room temperature is very low, but becomes considerable at temperatures exceeding 100° C. This results in that the apparatus will cease to work within very short time owing to corrosion products which are deposited and obstruct the pump pipe, which has the narrowest cross section for the circulating liquid.

The object of the invention is to bring about an absorption refrigerating apparatus of the kind introductorily set forth, where the construction is such, that corrosion, and by that obstruction of the pump pipe is suppressed.

This object is reached by the apparatus according to the invention thereby that the pump pipe is made of a material, which is more corrosion resistant to the media in the apparatus than the steel material in at least the condenser, evaporator, absorber and absorber vessel, and that in the boiler there are no joints between different materials, which can cause galvanic corrosion.

Figure 1:
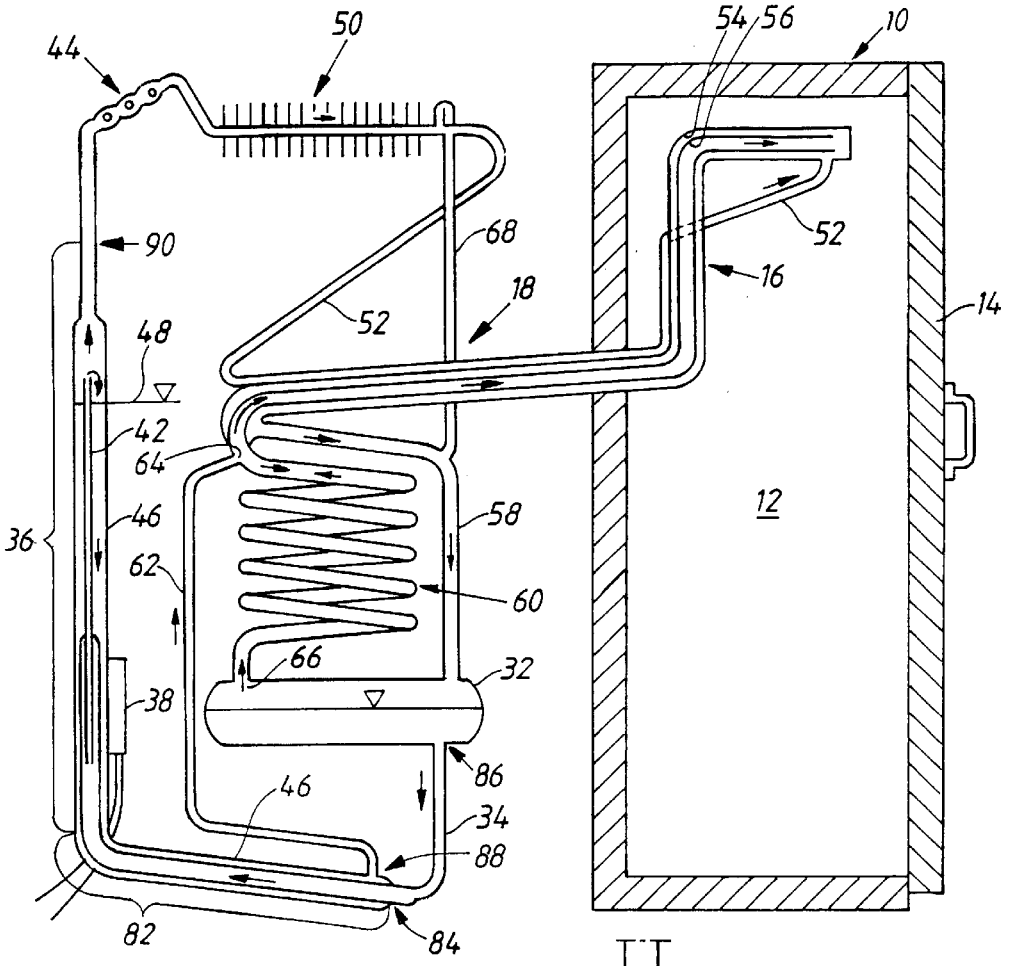
Figure 2:
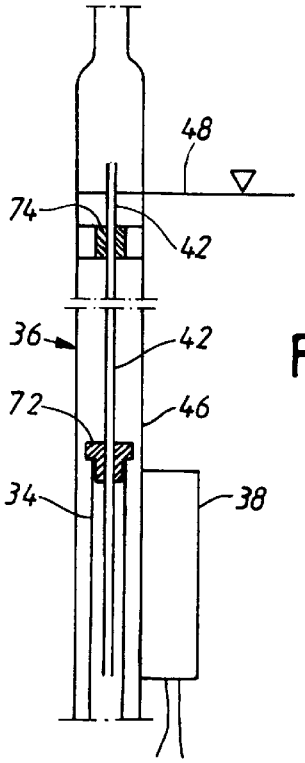

An embodiment of an absorption refrigerating apparatus according to the invention is described below in connection with the enclosed drawing, in which FIG. 1 shows a schematic picture of an absorption refrigerating apparatus and FIG. 2 shows an enlargement of a boiler of the apparatus.

By 10 is designated a refrigerator cabinet containing a refrigerated compartment 12, which is closable by a door 14. The compartment 12 is refrigerated by the evaporator 16 of an absorption refrigerating apparatus arranged behind the cabinet 10.

The refrigerating apparatus 18, which is of a known kind, e.g. through FIG. 1 of the previously mentioned EP patent No. 366 633, shows an absorber vessel 32 containing an absorption liquid, such as water, in which a refrigerant, such as ammonia, is dissolved. This solution, which is relatively rich in refrigerant, is called a rich solution. The rich solution exits from the absorber vessel 32 through a pipe 34 and enters a boiler 36 in which the rich solution is supplied with heat from an energy source, e.g. an electric heating cartridge 38. Refrigerant vapour boils off from the rich solution which thereby becomes a so-called weak solution. The mixture of refrigerant vapour and weak solution is expelled through a pump pipe 42, the refrigerant vapour continuing to a separator 44, which separates out absorption liquid accompanying the refrigerant vapour and the weak solution being collected in an outer pipe 46 of the boiler 36 to a certain level 48.

The refrigerant vapour flows from the separator 44 into a condenser 50, where heat is transferred from the vapour to the surrounding air so that the vapour condenses. The refrigerant condensate leaves the condenser through a pipe 52 and enters the evaporator 16, where the condensate meets a flow of an inert gas, such as hydrogen gas, and is vaporized in an outer pipe 54 in the inert gas during absorption of heat from the chamber 12. The inert gas is supplied to the evaporator 16 through an inner pipe 56 which is located within the outer pipe 54 and the mixture of inert gas and vaporized refrigerant exits from the evaporator 16 through the pipe 54 and continues via a pipe 58 to the absorber vessel 32.

From the absorber vessel 32, the mixture of refrigerant vapour and inert gas is elevated through an absorber 60 and meets the weak solution, which, driven by the level 48, comes from the pipe 46 via a pipe 62 into the upper part of the absorber 60 at 64. While flowing downwards through the absorber 60, the weak solution absorbs refrigerant vapour flowing upwards during rejecting of heat to the surrounding air, the weak solution thereby becoming a rich solution again before it flows down into the absorber vessel 32 at 66. The elevating inert gas continues from the absorber 60 to the pipe 56 and enters into the evaporator 16 and permits the refrigerant condensate to vaporize in it.

In order to prevent refrigerant vapour, which possibly has not condensed in the condenser, from collecting in the condenser and blocking the outflow of refrigerant condensate from the condenser, a vent pipe 68 is arranged between the outlet of the condenser 50 and the pipe 58, which pipe 68 leads gaseous medium to the absorber vessel 32.

The pump pipe 42 is made of another material than the rest of the apparatus, which material resists corrosion by the ammonia-water solution better than the rest of the apparatus. This material can e.g. be stainless steel. The boiler 36 and the rest of the apparatus 18 are made of a soft carbon steel.

By the different materials the pump pipe 42 and the rest of the apparatus will get different electrochemical potential, which can result in so-called galvanic corrosion. In order to prevent such galvanic corrosion the pump pipe 42 is electrically insulated from the boiler 36 and the rest of the apparatus 18 by at its lower end being connected with the pipe 34 by an electrically insulating bushing 72 and at its upper end being fixed laterally in the pipe 46 by an electrically insulating element 74.

The boiler 36 passes at its lower end into a heat exchanger 82, where rich solution on its way to the boiler 36 through the pipe 34 is heated by weak solution, which is on its way from the boiler 36 to the absorber 60.

According to a variant of the invention the pipe 34 is made of the same stainless steel as the pump pipe 42 and welded together with it. Electrically insulating elements keep the pipes 34 and 42 at a distance from the pipe 46, so that galvanic corrosion does not arise in the boiler. At this joints between different materials will occur at two places, viz. on one hand at 84, where the pipe 34 is welded together with the pipe 46 and on the other hand at 86, where the pipe 34 is welded together with the absorber vessel 32. At these two places the corrosion is not as problematic as in the boiler, as the temperature here is substantially lower than in the boiler.

According to a further variant of the invention as well the boiler 36 as the heat exchanger 82 with the pipes 46 and 34 are made of the same stainless steel as the pump pipe 42. At this no measures have to be taken to prevent galvanic corrosion in the boiler. At this joints between different materials will occur at three places, viz., besides at 86, also at 88, where the pipe 62 is welded together with the pipe 46, and at 90, where the boiler 36 is welded together with the pipe, which leads to the separator 44. At the joints 86 and 88 the corrosion is not as problematic as in the boiler as a consequence of the temperature here being substantially lower than in the boiler. At the joint 90 the concentration of water is low and the corrosion therefore becomes less problematic here than in the rest of the boiler.

The improved protection against corrosion which is obtained by the apparatus according to the invention can at need be made more complete by a suitable, more environmentally friendly corrosion inhibitor, which is added to the media in the apparatus and which does not have to be as effective against corrosion as the sodium chromate mentioned in the introduction.

What is claimed is:

1. Absorption refrigerating apparatus (18) of steel, where a dissolvable refrigerant by means of an absorption liquid, circulates through in turn a boiler (36) where refrigerant is liberated from the absorption liquid;

a condenser (50) where the refrigerant condenses;

an evaporator (16) where the refrigerant evaporates;

an absorber (60) where the refrigerant is absorbed by the absorption liquid, and an absorber vessel (32) for collecting the absorption liquid, from which absorber vessel (32) the absorption liquid circulates back to the boiler (36), where the absorption liquid is heated in a pump pipe (42) so that the refrigerant is again liberated from the absorption liquid, characterized in that the pump pipe (42) is made of a more corrosion resistant material, than the steel material used in the condenser (50), the evaporator (16), the absorber (60) and in the absorber vessel (32), and that in the boiler (36) there are no joints between different materials, which can cause galvanic corrosion.

2. Apparatus according to claim 1, characterized by a pipe (34), which conducts refrigerant dissolved in the absorption liquid from the absorber vessel (32) through a heat exchanger (82) to the pump pipe (42), is made of the same material as the pump pipe (42).

3. Apparatus according to claim 2, characterized in that the boiler (36) and the rest of the heat exchanger (82) are made of the same material as the pump pipe (42).

4. Apparatus according to claim 1, characterized in that the pump pipe (42) alone is made of the more corrosion resistant material, galvanic corrosion being prevented by the pump pipe (42) being electrically insulated from the rest of the boiler.

5. Apparatus according to claim 4, characterized in that the electrical insulation is constituted by a bushing (72) of an electrically insulating material.

6. Apparatus according to claim 5, characterized in that the pipe (42) is kept on place in the boiler (36) by a further electrically insulating element (74).

* * * * *